US010525520B2

(12) United States Patent
Kobayashi et al.

(10) Patent No.: US 10,525,520 B2
(45) Date of Patent: Jan. 7, 2020

(54) POLYGONAL CAN AND METHOD FOR FORMING THEREOF

(71) Applicant: TOYO SEIKAN GROUP HOLDINGS, LTD., Tokyo (JP)

(72) Inventors: Tomomi Kobayashi, Yokohama (JP); Naoya Matsumoto, Yokohama (JP); Takeshi Aihara, Yokohama (JP)

(73) Assignee: TOYO SEIKAN GROUP HOLDINGS, LTD., Tokyo (JP)

( * ) Notice: Subject to any disclaimer, the term of this patent is extended or adjusted under 35 U.S.C. 154(b) by 486 days.

(21) Appl. No.: 15/121,144

(22) PCT Filed: Feb. 26, 2015

(86) PCT No.: PCT/JP2015/055584
§ 371 (c)(1),
(2) Date: Aug. 24, 2016

(87) PCT Pub. No.: WO2015/129798
PCT Pub. Date: Sep. 3, 2015

(65) Prior Publication Data

US 2017/0008063 A1 Jan. 12, 2017

(30) Foreign Application Priority Data

Feb. 27, 2014 (JP) ..... 2014-36244
Feb. 27, 2014 (JP) ..... 2014-36245

(51) Int. Cl.
*B21D 51/26* (2006.01)
*B65D 1/18* (2006.01)
*B65D 6/02* (2006.01)

(52) U.S. Cl.
CPC ..... *B21D 51/2646* (2013.01); *B65D 1/18* (2013.01); *B65D 7/06* (2013.01)

(58) Field of Classification Search
CPC ..... B21D 51/2646; B21D 51/2669
(Continued)

(56) References Cited

U.S. PATENT DOCUMENTS 2,114,137 A * 4/1938 Conner ..... B65D 7/02 206/509
3,710,609 A * 1/1973 Jones ..... B21C 37/155 72/392

(Continued)

FOREIGN PATENT DOCUMENTS

JP 51-106677 9/1976
JP 1-317629 A 12/1989

(Continued)

OTHER PUBLICATIONS

International Search Report dated May 19, 2015, issued in counterpart international application No. PCT/JP2015/055584 (2pages).

*Primary Examiner* — Jason L Vaughan
(74) *Attorney, Agent, or Firm* — Westerman, Hattori, Daniels & Adrian, LLP

(57) ABSTRACT

Provided is a polygonal in which a decoration effect equivalent to that of a cylindrical base-can is obtained without causing folding or deformation in a can body-part. Bottom-part outer-peripheral parts (A-2) of a cylindrical base-can that are expected to form linear parts (B-2) of a polygonal can (B) are moved inward in a radial direction, while bottom-part outer-peripheral parts (A-1) of the cylindrical base-can that are expected to form corner parts (B-1) of the polygonal can are moved outward in the radial direction. Thus, the polygonal can is molded such that the body-part cross-section peripheral length of the cylindrical base-can and the body-part cross-section peripheral length of the molded polygonal can have a substantially isometric relationship.

6 Claims, 12 Drawing Sheets

(58) Field of Classification Search
USPC ..... 72/379.4
See application file for complete search history.

(56) References Cited

U.S. PATENT DOCUMENTS

| | | | | | |
|---|---|---|---|---|---|
| 3,759,203 | A | | 9/1973 | Frankenberg | |
| 3,996,783 | A | * | 12/1976 | Meserole | B21C 37/155 72/370.08 |
| 4,372,035 | A | * | 2/1983 | McMillen | H02K 1/17 29/596 |
| 4,803,881 | A | * | 2/1989 | Dudley | B21C 37/155 72/370.08 |
| 5,160,031 | A | * | 11/1992 | Palisin, Jr. | B21D 1/08 206/519 |
| 5,261,261 | A | * | 11/1993 | Ramsey | B21D 22/105 72/105 |
| 5,282,306 | A | | 2/1994 | Katsuhiro et al. | |
| 5,357,667 | A | * | 10/1994 | Schutz | B21D 39/03 29/509 |
| 5,499,438 | A | * | 3/1996 | Schutz | B65D 77/0466 29/407.01 |
| 5,727,414 | A | * | 3/1998 | Halasz | B21D 51/2646 72/348 |
| 5,902,086 | A | * | 5/1999 | Enoki | B21D 51/2646 413/69 |
| 6,260,403 | B1 | * | 7/2001 | Johnston | B21D 22/025 72/370.08 |
| 6,412,765 | B1 | * | 7/2002 | Blakeley | B21D 51/2646 269/48.1 |
| 6,712,575 | B1 | * | 3/2004 | Tuma | B21D 51/2646 220/669 |
| 7,104,104 | B1 | * | 9/2006 | Hermanson | F16L 9/003 138/163 |
| 9,101,969 | B2 | * | 8/2015 | Hermanson | B21C 37/127 |

FOREIGN PATENT DOCUMENTS

| | | | |
|---|---|---|---|
| JP | 11-208634 | A | 8/1999 |
| JP | 11-333538 | A | 12/1999 |
| JP | 2006-321508 | A | 11/2006 |
| JP | 2007-45458 | A | 2/2007 |
| JP | 2007-237185 | A | 9/2007 |
| JP | 2010-167459 | A | 8/2010 |
| JP | 2011-50979 | A | 3/2011 |

* cited by examiner

Prior Art

POLYGONAL CAN AND METHOD FOR FORMING THEREOF

TECHNICAL FIELD

The present invention relates to a bottomed polygonal can molded from a bottomed cylindrical base-can and a method for forming thereof.

BACKGROUND ART

Conventionally, in order to manufacture a metal polygonal can, e.g., in the case of manufacturing a two-piece can, there has been generally known a method in which a blank is subjected to drawing and ironing to form a bottomed cylindrical base-can and the cylindrical base-can is then formed into a bottomed polygonal can by a square die and a square punch (for example, Patent Literature 1). In addition, as another method, there has been known an impact extrusion molding method in which a bottomed polygonal can is formed from a slug made of a soft aluminum alloy by a punch and a die in a single step. In the case of manufacturing a three-piece can, there has been known a bulge forming method in which a bottomless cylindrical base-forming is internally expanded by water pressure to form a can body along the shape of an outer mold or a method in which a seam-bonded bottomless cylindrical body is pressed inward by an outer die having a processing surface with a mountain shape in cross section to form a body wall part and some parts of the cylindrical body that are expected to form corner parts are pressed outward by an inner die having a processing surface with an arc shape in cross section at its tip end to form the corner parts (Patent Literature 2). The latter method does not assume the forming of a bottomed cylindrical can into a bottomed polygonal can, and thus a bottomed polygonal can cannot be formed by this method.

CITATION LIST

Patent Literature

[PTL 1] Japanese Patent Application Laid-open No. 2010-167459

[PTL 2] Japanese Patent Application Laid-open No. 2011-50979

SUMMARY OF INVENTION

Technical Problem

In the above conventional method for forming a bottomed cylindrical can into a polygonal can, deformation is necessarily caused, when a bottom part is changed in shape from a cylindrical shape to a square shape, in the areas of the bottom part that are expected to form corner parts and linear parts since they are subjected to diameter-constriction processing and expansion processing, and the deformation is then transmitted to a body part, which gives rise to a problem that folding or deformation is caused in a body-part wall surface.

Meanwhile, in recent years, decorated cans obtained by adding more beautiful printing or painting to metal cans have been put into circulation. In the case of cylindrical cans, they can be decorated in a single step by multi-color curved-surface printing. However, in the case of polygonal cans, curved-surface printing cannot be applied. Therefore, in order to achieve the same decoration quality as that of cylindrical cans, it is necessary to separately print four surfaces. In this case, since a complicated printing step and an apparatus are needed for position alignment or the like, the productivity of the polygonal cans becomes poorer than that of the cylindrical cans and a dedicated decoration line has to be provided. In order to avoid this, there has been assumed, as schematically shown in, for example. FIG. 14, a method in which an image E is printed or painted on a can body by curved-surface printing when a cylindrical base-can A remains intact and then the cylindrical can is formed into a polygonal can. However, in the case of a cylindrical can (i.e., a two-piece can) having a bottom part, when a polygonal can is formed from the cylindrical can by the above conventional method, some areas of the bottom part extend over a body wall to be changed in shape with deformation or folding caused in the decorated surface of the body wall as shown in FIG. 14(*b*), which gives rise to a problem that high-quality decoration is not obtained. When deformation is caused in a can body, there is a likelihood that the gloss of finishing varnish applied onto an outermost surface to protect ink is reduced or the arrangement of dots is, in the case of dot printing, non-uniformly disordered to cause moiré fringes. In addition, in the area of solid painting, an amount of mounted ink becomes non-uniform or minute cracks become obvious under microscopic observation, which gives rise to a problem that a high-quality image is not obtained. This problem is also caused in film labels in the same way.

Moreover, in order to avoid this problem, it is assumed that a printed picture in which deformation possibly caused by forming is corrected in advance is added to a cylindrical can. However, due to unstable factors such as the anisotropy or non-uniformity of materials, it is difficult to obtain high-accuracy decoration.

In addition, when cylindrical cans and polygonal cans are compared with each other in terms of their display performance, the cylindrical cans are poor in operability since an accurate positioning operation is needed to display product names or the like toward a front side. On the other hand, the polygonal cans are advantageous in their high accommodation efficiency since they can be easily displayed with product names or the like directed to a near side and can be displayed without gaps. However, from the above reason, it is difficult to obtain polygonal cans with high-quality decoration.

Accordingly, the present invention has an object of providing a bottomed polygonal can in which a high-quality decoration effect equivalent to that of a cylindrical can is obtained without, causing folding or deformation in a can body wall when forming the cylindrical can into a polygonal can, and providing a method for forming the same.

Solution to Problem

In order to solve the above problems, the present invention provides a polygonal can formed from a cylindrical base-can formed of a body part and a bottom part, wherein a bottom-part periphery and a body-part cross-sectional surface each have a substantially polygonal shape formed of linear parts and corner parts, and a body-part cross-section peripheral length of the cylindrical base-can and a body-part cross-section peripheral length of the molded polygonal can have a substantially isometric relationship.

The polygonal can is formed while withdrawing parts are formed in some areas of a bottom surface inside a bottom-part outer-peripheral part of the cylindrical base-can, the bottom-part outer-peripheral part being expected to form the linear parts in the cross-sectional surface. Thus, the linear parts are reliably obtained by an isometric change.

In addition, the polygonal can is formed from the cylindrical base-can in which material supply parts are formed in some areas of the bottom surface inside the bottom-part outer-peripheral part of the cylindrical base-can, the bottom-part outer-peripheral part being expected to form corner parts in the cross-sectional surface. Thus, the corner parts are reliably obtained by the isometric change.

The body part of the polygonal can may be embossed where necessary.

In addition, as the die of the polygonal can, an opening part is flanged such that a can cover can be seamed. Thus, the can cover can be seamed by a general seaming device. When the opening part is flanged roundly, a circular can-cover can be seamed by the same seaming device as that for a cylindrical can.

Moreover, the polygonal can has a screw part at its opening part to which a screw cover can be attached. Thus, a decorated square bottle-can can be provided.

Further, the polygonal can has a bottom-rim-shaped protrusion formed on its bottom surface. Thus, conveyance or the like can be improved.

In order to solve the above problems, the present invention also provides a method for forming a polygonal can by which a cylindrical base-can formed of a body part and a bottom part is formed into the polygonal can having linear parts and corner parts in a body-part cross-sectional surface thereof, wherein a shape of a bottom-part outer-periphery is changed into a shape corresponding to a cross-sectional surface of the polygonal can by linear-part forming means for moving, inward in a radial direction, a bottom-part outer-peripheral part of the cylindrical base-can that is expected to form the linear parts of the polygonal can and by corner-part forming means for moving, outward in the radial direction, the bottom-part outer-peripheral part of the cylindrical base-can that is expected to form the corner parts, and a cross-sectional peripheral length of a can body is substantially same before and after the forming.

By the employment of the above configuration, a can-body side-wall is simply bent. Therefore, no deformation is caused in a decorated surface.

Accordingly, since a cylindrical base-can is decorated before being formed into a square shape, a beautifully-decorated surface added to the cylindrical base-can can be maintained. Thus, an efficiently-decorated polygonal-can can be obtained.

Further, in the method for manufacturing the polygonal can, when the bottom-part outer-peripheral part of the cylindrical base-can that is expected to form the linear parts at the bottom part of the polygonal can is moved inward in the radial direction, convex parts are formed in some areas of a bottom surface, which is desirable in that some of the material of the parts changing in shape can be absorbed by the convex parts in the linear parts and thus the forming can be performed more satisfactorily.

In addition, material supply parts are formed in some areas of the bottom part of the cylindrical can that is expected to form the corner parts at the bottom part of the polygonal can, and the bottom-part outer-periphery of the cylindrical can that is expected to form the corner parts at the bottom part of the polygonal can is moved outward in the radial direction while the material supply parts are pressed by a crushing member inserted in the can. Thus, the corner parts can be satisfactorily formed without causing deformation in side-wall parts.

Moreover, in the method for forming the polygonal can, linear-part forming by the linear-part forming means for moving the bottom-part outer-peripheral part of the cylindrical base-can inward in the radial direction and corner-part forming by the corner-part molding means for moving the bottom-part outer-peripheral part of the cylindrical base-can outward in the radial direction are performed in a same step, and a press tool is used as the linear-part deformation means for moving the bottom-part outer-peripheral part of the cylindrical base-can inward in the radial direction, whereby the polygonal can can be efficiently formed.

Further, in the method for forming the polygonal can, a body part of the polygonal can is embossed by the press tool and a shaft inserted in the can, which is desirable in that the strength of the side walls can be improved and a can material can be further thinned.

Advantageous Effects of Invention

According to the polygonal can of the present invention, the body-part cross-section peripheral length of the cylindrical base-can and the body-part cross-section peripheral length of the formed polygonal can have a substantially isometric relationship. Therefore, since the body wall is only bent, deformation or folding is not caused in the decorated picture of the body wall and the gloss of finishing varnish applied onto an outermost surface to protect ink is not reduced. In addition, since the arrangement of dots is free from non-uniform deformation in the area of dot printing, moiré fringes are not caused. Moreover, since an amount of mounted ink remains uniform and minute cracks are not obvious under microscopic observation in the area of solid painting, the polygonal can decorated with high quality can be obtained. This also produces the same effect in a label decoration method in which a print film is bonded, and prevents the separation of a film due to molding. Further, since deformation is not caused in a decorated picture when hologram decoration is applied, the quality and luminescence of decoration is maintained.

In addition, the polygonal can is molded while the withdrawing parts are formed in some areas of the bottom surface outside the bottom-part outer-peripheral part of the cylindrical base-can, the bottom-part outer-peripheral part being expected to form the linear parts in the cross-sectional surface. Thus, since the extra material of the bottom-part periphery caused when the linear parts are formed is moved into the withdrawing parts of the bottom-part surface, the extra material does not extend over the body part. As a result, the isometrically-changed polygonal can is easily obtained.

Moreover, the polygonal can of the present invention is formed from the cylindrical base-can in which the material supply parts are formed in some areas of the bottom surface inside the bottom-part outer-peripheral part of the cylindrical base-can, the bottom-part outer-peripheral part being expected to form the corner parts in the cross-sectional surface. Thus, since an insufficient material is supplied from the material supply parts at the forming of the corner parts, the isometrically-changed polygonal can that does not cause deformation in the can body is easily obtained.

Moreover, when the polygonal can of the present invention is embossed at its body part, the rigidity of the can body-part increases. For example, deformation is prevented from being caused in the body wall when the polygonal can is under negative pressure. As a result, a high-quality decorated surface can be maintained, and the thinning of a can material can be promoted.

Further, the opening part of the polygonal can of the present invention is not limited to a square shape, and the polygonal can may be obtained in various modes such as a polygonal can that is flanged to have a polygonal or circular opening part to be capable of seaming a polygonal or circular can-cover and a polygonal can in which an opening part is formed into a mouth part having a screw part to be capable of seaming a screw cover.

According to the method of the present invention, the shape of the bottom-part outer-periphery is changed into the shape corresponding to the cross-sectional surface of the polygonal can, and the peripheral length of the can body can be made substantially the same before and after the shape of the polygonal can is changed from a circular shape to a square shape. Therefore, the side wall is only bent, and deformation is not caused in a decorated picture. In addition, in a label decoration method in which a print film is bonded, the separation of a film due to forming can be prevented. Moreover, since deformation is not caused in a decorated picture when hologram decoration is applied, the quality and luminescence of decoration is maintained.

In addition, decoration can be added to a cylindrical can by a conventional decoration machine, and the beautifully-decorated surface of a cylindrical can can be maintained even after the cylindrical can is molded into a polygonal can. Therefore, the polygonal can with higher decoration than before can be efficiently obtained.

Moreover, when the bottom-part outer-peripheral part of the cylindrical can that is expected to form the linear parts at the bottom part of the polygonal can is moved inward in the radial direction in some areas of the bottom part, convex parts are formed in the areas of the bottom part. Thus, in the linear parts, some of the material of the parts changing in shape can be withdrawn and absorbed by the convex parts of the bottom part. As a result, an extra material is prevented from extending over the side wall, and the polygonal can can be satisfactorily molded without causing deformation in the side wall.

Moreover the material supply parts are formed in some areas of the bottom part of the cylindrical can that is expected to form the corner parts at the bottom part of the polygonal can, and the bottom-part outer-periphery of the cylindrical can that is expected to form the corner parts at the bottom part of the polygonal can is moved outward in the radial direction while the material supply parts are pressed by a crushing member inserted in the can. Thus, the material can be supplied to the corner parts outwardly protruding from the outer peripheral part of the cylindrical can, the influence of deformation on forming the can body-part can be reduced, the thinning of the corner-part outer-peripheral part can be prevented, and the corner parts can be satisfactorily formed.

Moreover, the forming of the linear parts and the forming of the corner parts are performed in the same step at the forming of the polygonal can, and the press tool is used as means for moving the bottom-part outer-peripheral part of the cylindrical can inward in the radial direction. Thus, a forming device can be simplified, and the forming can be efficiently performed.

Furthermore, when the side wall is embossed simultaneously with the forming of the polygonal can, the rigidity of the side wall can be effectively improved and a can material can be made thinner. When an embossed shape is a horizontal or perpendicular line, the perpendicularity of the side wall can be assured.

REFERENCE SIGNS LIST

Figure 1:
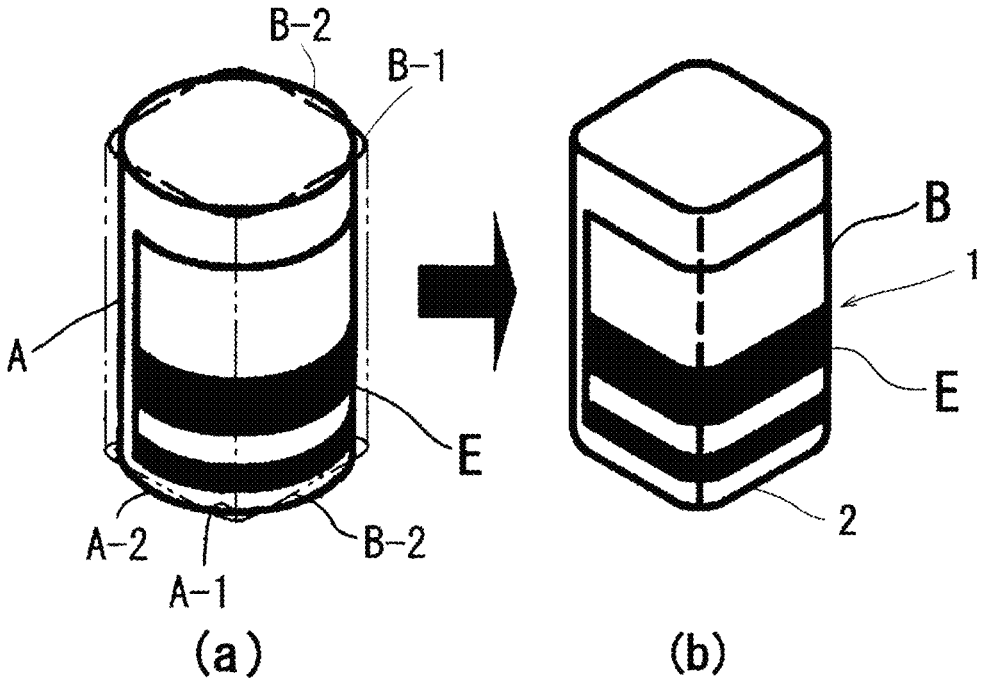
FIG. 1 is a conceptual view schematically showing the characteristic parts of a polygonal can formed from a cylindrical base-can according to the present invention.

1, 50, 55, 60 Polygonal can
3, 32 Press tool
4, 40 Lower die
5, 13 Shaft
6, 14 Expansion tool
8, 16 Concave part
9, 41 Protrusion
10 Upper-die assembly
11 Upper-die base
17 Can-body expansion part
18 Driving part
19 Pivot

25 Press-tool operation rod
26 Contact head part
30 Lower-die assembly
31 Lower-die base
33 Linear guide
34 Member
35 Bell crank
36 Driving arm
37, 38 Contact part
45 Expansion-tool driving rod
A Cylindrical can
A-1 Bottom-part outer-peripheral part of cylindrical can that is expected to form corner parts
A-2 Bottom-part outer-peripheral part of cylindrical can that is expected to form linear parts
B Polygonal can
B-1 Corner part of polygonal can
B-2 Linear part of polygonal can
C Material supply part
D Withdrawing part
F Emboss

DESCRIPTION OF EMBODIMENTS

Hereinafter, based on the drawings, a description will be given of an embodiment of a method for forming a polygonal can according to the present invention.

FIG. 1 is a conceptual view in which a bottomed cylindrical base-can A is forming to obtain a bottomed polygonal can B. An optional image E is added to the can body of the bottomed cylindrical base-can A shown in FIG. 1(*a*) for decoration and then formed by a method that will be described later to obtain the bottomed polygonal can B according to the present invention shown in FIG. 1(*b*) (hereinafter called a polygonal can 1 according to the embodiment). The polygonal can 1 has a substantially polygonal shape (a substantially square shape in cross section in the embodiment) in which a bottom-part periphery 2 and a body-part cross-sectional surface are formed of linear parts and corner parts and a decorated surface E of the cylindrical base-can and a decorated surface. B of the body part of the formed polygonal Can have a substantially isometric relationship. As a result, the body wall is only bent and deformation is not caused in the decorated surface. E when the cylindrical base-can is formed into the polygonal can, and high quality is maintained like the decorated surface of the cylindrical base-can after the forming.

Note that in order to confirm the substantial isometric relationship about the can body-part before and after the forming, it is only necessary to simply measure the gloss of finishing varnish with a commercially-available gloss checker when the can body-part is varnished. In the area of solid painting, the substantial isometric relationship can be determined by the confirmation of minute cracks under microscopic observation. Besides, it is also possible to confirm the substantial isometric relationship based on the presence or absence of moiré fringes or deformation.

Figure 4:
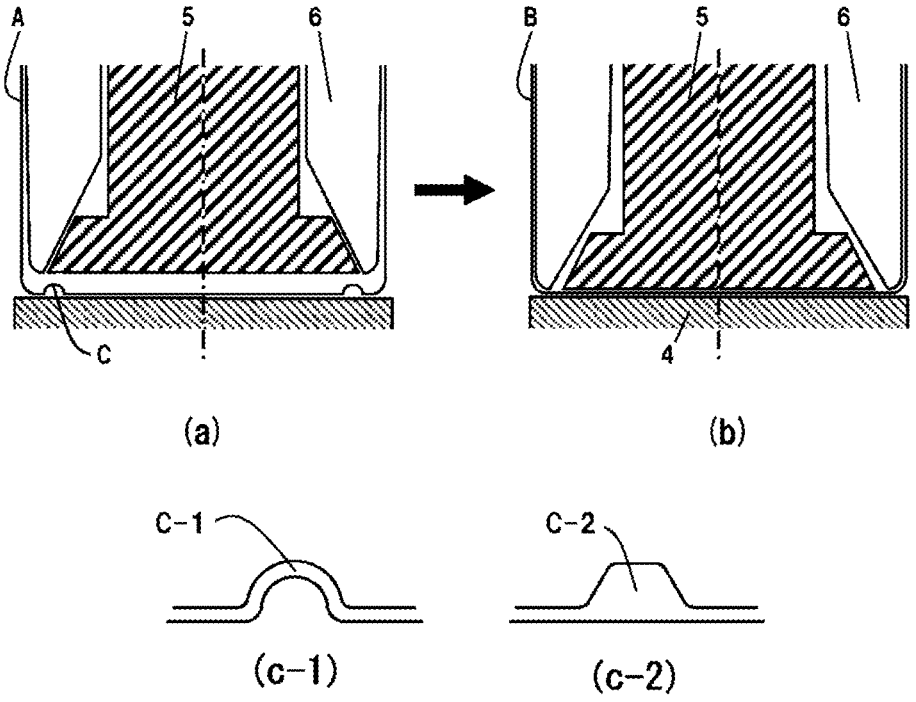
FIG. 4 shows the cross section of a unit for forming corner parts in the method for forming the polygonal can according to the embodiment of the present invention, wherein (a) shows a state before the forming starts, (b) shows a state after the forming ends, and (c-1) and (c-2) show other examples of material supply parts.
Figure 5:
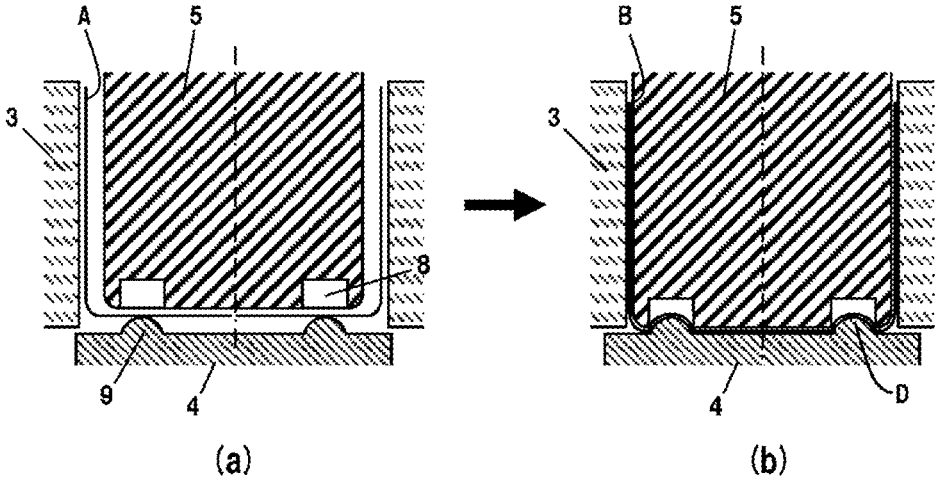
FIG. 5 shows the cross section of a unit for forming linear parts, wherein (a) shows a state before the forming starts and (b) shows a state after the forming ends.

Hereinafter, based on FIG. 3 to FIG. 5, a description will be given in detail of the embodiment of the method for forming the polygonal can according to the present invention from the bottomed cylindrical can.

Figure 3:
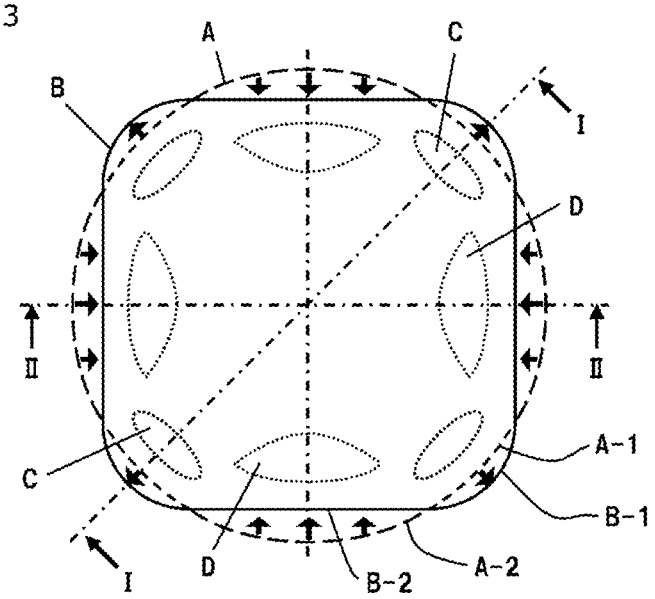
FIG. 3 is a schematic view showing the principle of a method for forming the polygonal can according to the present invention.

FIG. 3 is a virtual view of the bottom parts of the cylindrical base-can A and the polygonal can B having the same peripheral length with their axes aligned with each other to describe the basic concept of the forming method according to the embodiment of the present invention. In FIG. 3, when the polygonal can B having the same peripheral length is formed from the cylindrical base-can A, parts A-1 corresponding to corner parts B-1 of the polygonal can spread to an outside to form the corner parts B-1 by a conventional method since, they are positioned inside the polygonal can. Since an insufficient material is withdrawn from the bottom part and the can body-part, deformation is also caused in the can body near the bottom part. Conversely, parts A-2 that are expected to form linear parts B-2 are pressed from the outside to form the linear parts B-2 since they are positioned outside the linear parts of the polygonal can. Accordingly, at this time, since the parts that are expected to form the linear parts are reduced in diameter to cause an extra material and the extra material extends over the body wall part, deformation is caused in the body wall part.

In order to solve the problem, the method for forming the polygonal can according to the embodiment employs the following method.

Step 1: When the cylindrical base-can is formed by drawing and ironing, material supply parts C having a convex shape are formed inside the bottom part at which the corner parts are expected to be formed in the cross-sectional surface of the polygonal can. In the embodiment, the material supply parts C are formed at four corner positions so as to be placed diagonally to each other as shown in FIG. 3 and FIG. 4. However, the positions of the material supply parts C are not necessarily limited to the four corner positions. For the decoration of the cylindrical base-can, the cylindrical base-can may be decorated before or after the material supply parts C are formed in the cylindrical base-can.

Step 2: As shown in FIG. 3 and FIG. 4, the for corner parts are molded in such a way that the material supply parts C provided in the bottom part of the cylindrical base-can A are crushed by the end surface of a shaft 5 while a bottom-part outer-peripheral part is moved outward in a radial direction by an expansion tool 6.

Step 3: As shown in FIGS. 5(*a*) and 5(*b*), the cylindrical base-can A is pressed to the inside in the radial direction by a press tool 3. At this time, withdrawing parts D in which the material is to be withdrawn are formed in some areas of the bottom part such that the material pressed in the radial direction is absorbed in the withdrawing parts.

Through the above steps, the material supply parts C are formed in advance in some areas of the bottom part near the bottom-part outer-peripheral parts A-1, the areas being expected to form the corner parts of the polygonal can. Thus, the material can be supplied from the material supply parts C to the corner parts, which are formed to outwardly protrude from the outer peripheral part of the cylindrical base-can, to form the corner parts, and the influence of deformation on molding the can body-part can be reduced. In addition, at the same time, the material withdrawing parts D are formed in the bottom part as the body wall is pressed by the press tool, and an extra material is withdrawn into the withdrawing parts with the reduction in the diameter. Therefore, since the movement of the material to the can body-part is hindered, deformation possibly caused in the can body can be reduced.

As a result, the shape of the bottom-part outer-periphery of the cylindrical base-can is changed into a shape corresponding to the cross-sectional surface of the polygonal can, the peripheral length of the can body can be made substantially the same before and after the change, the body wall is only bent, and deformation or folding is not caused in the surface of the can body. When the material supply parts C and the withdrawing parts D remain in the bottom surface as the processing surfaces of the material supply parts and the processing surfaces of the withdrawing parts after the forming of the polygonal can, it is possible to correct the material supply parts C and the withdrawing parts D to be made inconspicuous.

A polygonal-can forming device for performing the above steps according to the embodiment is constituted by the shaft 5 inserted in the cylindrical base-can, the press tool 3 used to press the positions, at which the linear parts of the polygonal can are to be formed, from the outside, and a lower mold 4.

The shaft 5 used to mold the linear parts and the bottom part of the polygonal can is constituted by four expansion tools 6 (FIG. 4) used to move the positions, at which the corner parts are to be formed, to the outside to form the corner parts, and the concave parts 8 (FIG. 5) used to form the withdrawing parts are each formed in the end surface of the shaft 5 inside the periphery at the positions at which the linear parts are to be formed. The end surface of the shaft is formed into a shape corresponding to the shape of the inner peripheral surface of the linear parts of the polygonal can that is to be formed.

The lower mold 4 is a forming tool used to form the bottom part of the polygonal can in cooperation with the shaft 5 and has a plurality of protrusions 9 (FIG. 5) used to withdraw the material so as to form convex parts as a plurality of withdrawing parts D in some areas of the bottom part inside the outer peripheral part expected to form the linear parts at positions corresponding to the concave parts 8 of the end surface of the shaft.

By the polygonal-can forming device having the above configuration, the polygonal can B is formed from the separately-molded bottomed cylindrical base-can A as follows.

In the case of a decorated can, a cylindrical base-can is appropriately decorated in advance on its outer peripheral surface through printing, painting, or the like. In forming the cylindrical base-can, the convex parts that are expected to form the material supply parts C are formed in advance inside the inner periphery at the respective positions at which the corner parts of the polygonal can are expected to be formed. When the forming starts in a state in which the shaft 5 is positioned inside the cylindrical base-can A having the convex parts, a diagonal cross section I-I of the corner parts shown in FIG. 3 is put in a state shown in FIG. 4(*a*) and a cross section II-II of the linear parts is put in a state shown in FIG. 5(*a*).

When the shaft 5 is moved downward and the expansion tools 6 are mutually moved outward in a diagonal direction in this state, the convex parts serving as the material supply parts C at the bottom part of the cylindrical base-can are crushed flatly by the end surface of the shaft 5 while an outer peripheral body wall at the bottom part is spread by the expansion tools 6 to formed the corner parts. Since the material flows from the material supply parts to the formed corner parts at this time, the corner parts can be formed without causing deformation in the outer peripheral body wall at the bottom part.

On the other hand, at linear-part forming surfaces, the press tool 3 is moved in a constricting fashion from the our surfaces on the outside toward the inside of the can while the shaft 5 is moved downward, whereby the outer peripheral part of the cylindrical base-can is pressed to form square side-surfaces. At this time, when the shaft 5 is moved downward by the constriction of the press tool 3, the bottom surface of the bottom part comes in contact with the protrusions 9 formed on the top surface of the lower mold 4 to be pressed into the concave parts 8 on the end surface of the shaft that are formed opposite to the protrusions, and the extra material at the bottom part reduced in diameter after being pressed by the press tool 3 is withdrawn into the concave, parts 8 (FIG. 5(*b*)) Therefore, deformation in the bottom-part outer-peripheral part due to the reduction in the diameter of the linear parts of the bottom part can be reduced to a greater extent.

As a result, the bottom-part outer-peripheral part can be formed into a square shape through substantial isometric transformation with the linear parts and the corner parts being free from deformation to a greater extent. Accordingly, the can body-part at the upper part of the bottom peripheral wall is only subjected to folding processing in the isometric transformation to be formed. Therefore, it is possible to maintain a decoration effect on the outer peripheral surface of the cylindrical base-can without causing deformation in a decorated surface.

Figure 6:
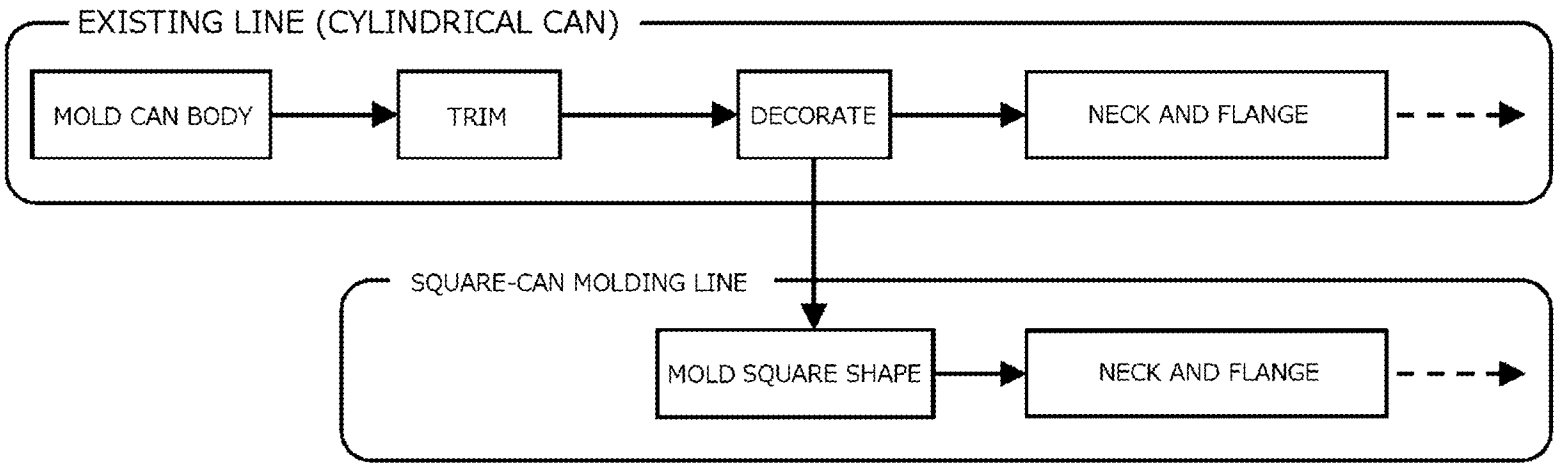
FIG. 6 is a block diagram showing a polygonal-can manufacturing step to which the method for manufacturing the polygonal can according to the embodiment of the present invention is applied.

When a decorated polygonal can is obtained by the method for forming a polygonal can according to the present invention as described above, an existing manufacturing line for two-piece cylindrical cans can be used as it is until its decoration step as shown in the block diagram of FIG. 6. A decorated bottomed cylindrical base-can is formed into a polygonal can by the forming method according to the embodiment in a polygonal-can forming line, and then the polygonal can is subjected to neck and flange forming or the like in the polygonal-can molding line. Thus, it is possible to obtain a polygonal can decorated like a cylindrical base-can with good manufacturing efficiency.

Figure 7:
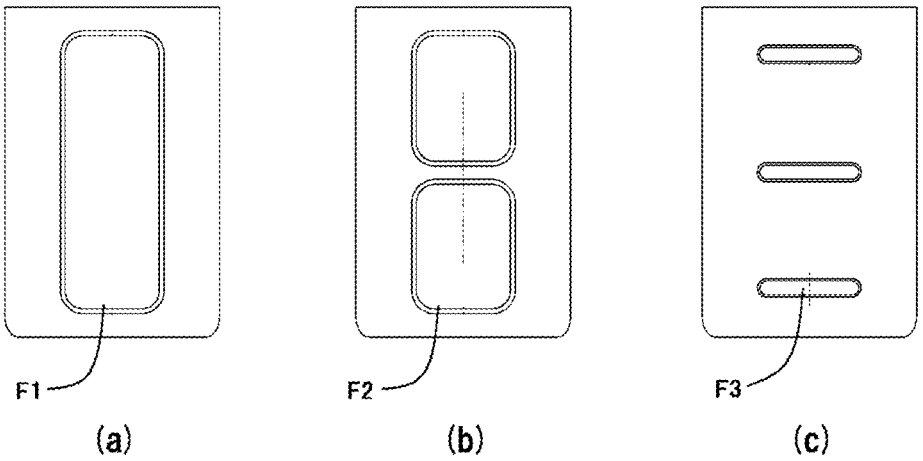
FIG. 7(*a*) to (*c*) are front views showing embodiments of emboss patterns applied to the body wall of the polygonal can.

In addition, it is possible to subject the can-body linear part of a polygonal can to emboss molding as shown in, for example, FIG. 7 where necessary. The emboss forming may be performed in a separate step after square forming or may be performed in the same step as the square forming. In a case that the emboss forming is performed along with the square forming, an emboss die and an opposite mold are formed on the linear-part molding surface of a shaft and the opposite surface of a press tool, respectively. Thus, a linear surface can be embossed by the cooperation between the press tool and the shaft as the linear part of a polygonal can is formed from a cylindrical base-can. Moreover, when an emboss is formed into a shape having horizontal lines or vertical lines as shown in, for example, F1 to F3 of FIGS. 7(*a*) to 7(*c*), a decorated can that increases the rigidity of its body, reduces the deformation of the can body with the perpendicularity of its body wall, and is more effective for negative pressure or the like can be obtained. Also, an emboss having a shape adapted to a printed picture can be formed.

Example

Figure 8:
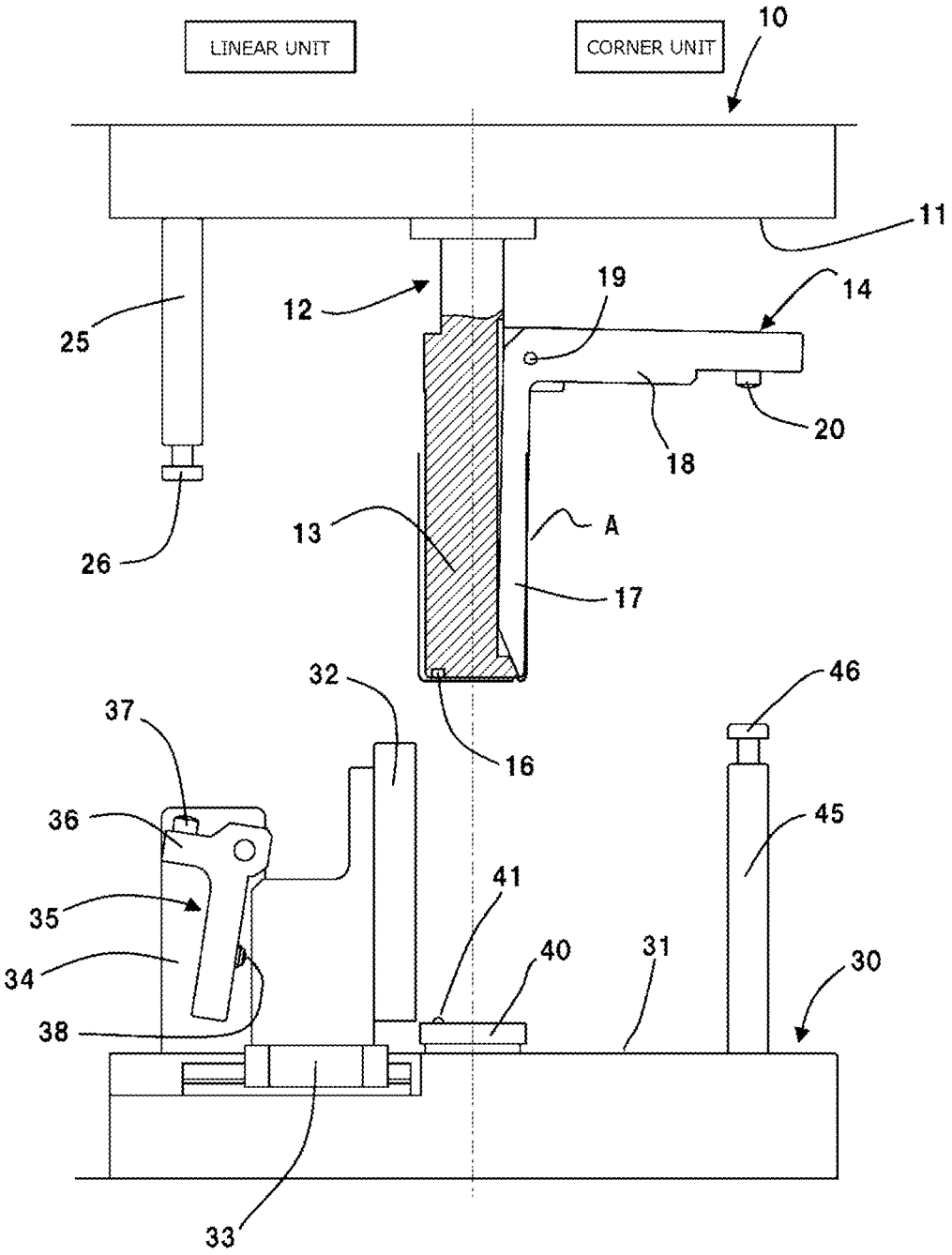
FIG. 8 shows an example of a polygonal-can forming device for performing the method for forming the polygonal can according to the present invention, wherein a right-half side and a left-half side relative to a center line show a corner-part forming unit and a linear-part forming unit, respectively, before the forming starts.
Figure 9:
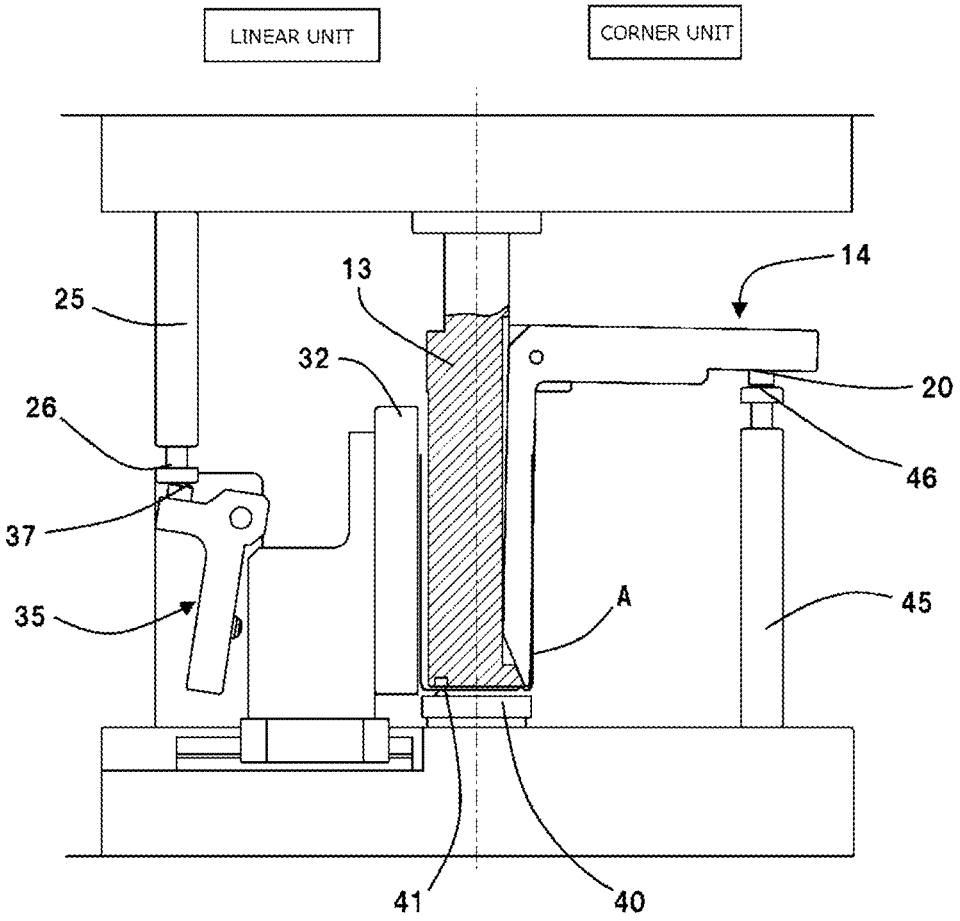
FIG. 9 shows a state in which the forming by the device shown in FIG. 8 starts.
Figure 10:
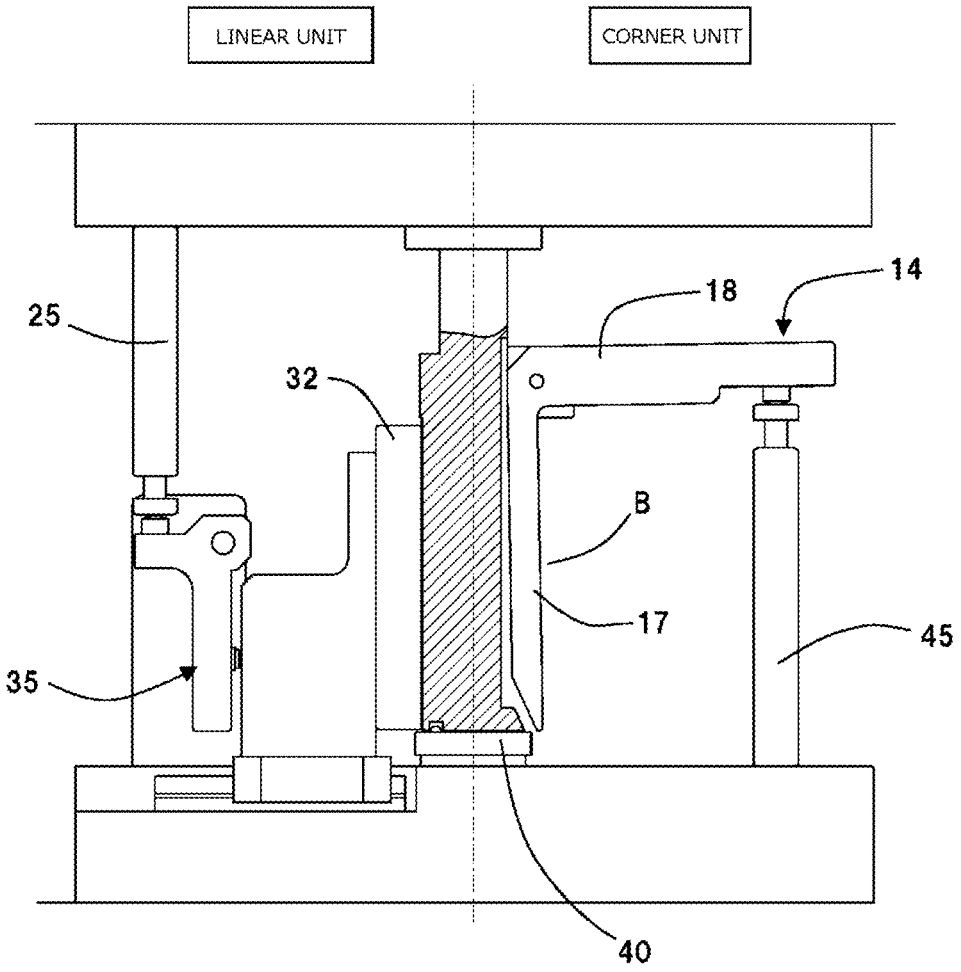
FIG. 10 is a state in which the forming by the device shown in FIG. 8 ends.

FIG. 8 to FIG. 10 show an example of the polygonal-can forming device for performing the method for forming the polygonal can according to the present invention.

In the figures, a right-half side and a left-half side relative to a center line show the cross section of a corner-part forming unit and the cross section of a linear-part forming unit, respectively. The polygonal-can forming device according to the example has an upper-die assembly 10 and a lower-die assembly 30, and both of the assemblies are arranged so as to be capable of relatively contacting and separating from each other in a coaxial direction. On an upper-die base 11 of the upper-die assembly 10, an inner-die assembly 12 and a press-tool operation rod 25 having a contact head part 26 at its lower end are provided in a suspended state.

The inner assembly 12 is constituted by a shaft 13 used to form the linear parts and the bottom part of the polygonal can and four expansion tools 14 used to move the positions, at which the corner parts are expected to be formed, to the outside to form the corner parts. On the lower end surface of the shaft 13, a crushing part and concave parts 16 used to form the withdrawing parts inside the periphery at the positions of the respective linear parts of the bottom-part outer-periphery as described above are each formed. The expansion tools 14 are formed into a bell crank shape having a can-body expansion part 17 and a driving part 18 and swingably attached to a pivot 19 having a pivot point at a bracket on the upper side of the shaft as shown in the figures. On the tip end of the driving part 18, a contact part 20 is provided that comes in contact with a head part 46 of an expansion-tool operation rod 45 provided to stand on the lower mold 30 that will be described later to swing the can-body expansion part 17. The tip end of the can-body expansion part 17 of the expansion tool 14 is configured to be formed into a wedge shape as shown in the figures, have its tip positioned on the inner periphery of a bottom-part molding part, and be capable of expanding the bottom-part outer-peripheral part of the can body from the inside as the tip swings.

On the lower-die base 31 of the lower-die assembly 30, a press tool 32 used to mold the linear parts of the can body is provided to be capable of reciprocating in a horizontal direction along a linear guide 33 with respect to the can body such that it presses the can body-part including the bottom-part outer-peripheral part from the outside. In addition, the lower-die base 31 is provided with a press-tool driving member. The press-tool driving member is formed of a bell crank 35 swingably supported by a member 34 provided to stand on the lower-die base. The bell crank 35 swings when the contact head part 26 of the press-tool operation rod 25 provided on the upper-die assembly comes in contact with a contact part 37 provided on a driving arm 36, and a contact part 38 provided on the lower side of the bell crank 35 presses the press tool 32 and squeezes the can body to form the linear parts.

In addition, on the lower-die base 31, a lower die 40 is fixed at a position opposite to the end surface of the shaft 13 of the upper die. The lower die 40 is a forming tool used to mold the bottom part of the polygonal can in cooperation with the shaft 13 and has, on its upper end surface, a plurality of protrusions 41 used to withdraw the material so as to form a plurality of convex parts inside the outer peripheral part expected to form the linear parts of the bottom part at the positions opposite to the concave parts 16 of the lower end of the shaft 13. Moreover, on the lower-die base 31, the expansion-tool driving rod 45 used to operate the expansion tools 18 provided on the upper die is provided to stand.

Accordingly, in the above example, the press tool 32, the bell crank 35 serving as the press-tool driving member, and the press-tool operation rod 25 constitute means for moving the bottom-part outer-peripheral part and the can-body outer-peripheral part of the cylindrical can that is expected to form the linear parts inward in the radial direction. In addition, the expansion tools 14 and the expansion-tool driving rod 45 constitute means for moving the bottom-part outer periphery of the cylindrical can that is expected to form the corner parts outward in the radial direction.

The Square molding device configured as described above is put in the state shown in FIG. 8 before the forming, in which the cylindrical can (base can) is attached to the outer peripheral part of the inner-die assembly 17.

When the upper die moves downward in this state, the contact head part 26 of the press operation rod 25 provided on the upper die contacts the contact part 37 of the bell crank 35 provided on the lower mold, while, in a corner forming part, the contact part 20 of the expansion tool 14 comes in contact with the head part of the expansion-tool operation rod 45 provided to stand on the lower-die base to produce a forming start state in which the expansion tool 14 and the press tool operate as shown in FIG. 9. In addition, in this state, the bottom-part surface of the cylindrical can A that is expected to form the linear parts comes in contact with the protrusions 41 serving as the withdrawing-part forming means of the lower die (see FIG. 5(*a*)), and the end surface: of the shaft 13 comes in contact with the upper surface of the material supply parts C formed on the bottom part that is expected to form the corner parts (see FIG. 4(*a*)).

When the shaft further moves downward in this state, the press tool, the shaft, and the expansion tools operate together. The bottom surface of the bottom part contacts the protrusions 41 formed on the top surface of the lower die 40, and the extra material at the bottom part reduced in diameter after being squeezed by the press tool 32 is withdrawn into the concave parts 16 of the shaft as the shaft moves downward, whereby the linear parts are formed while the withdrawing parts D are formed on the bottom surface (see FIG. 5(*b*)). At the same time, when the expansion tools are opened, the bottom-part outer-peripheral part is spread as the material supply parts C are crushed by the shaft. Thus, the corner parts are formed at the four corners (see FIG. 4(*b*)), and forming is finished.

The example of the polygonal-can forming device for performing the present invention is described above. However, the polygonal-can forming device is not limited to the above example and may be modified in design in various ways within the range of its technical idea. For example, although not shown in the figures, the expansion tools and the press tool can be driven by hydraulic pressure, air pressure, or an actuator such as a servo motor in synchronization with a descending position of the shaft.

In addition, the material supply parts and the withdrawing parts formed in the bottom part of the cylindrical base-can are not limited to a case in which one convex part is provided for one corner part but can employ a case in which a plurality of small convex parts or convex parts having an appropriate shape can be provided for one corner part. Moreover, the withdrawing parts are not limited to a case in which one convex part is formed for one linear part, but it is possible to optionally change the shape and the number of the convex parts formed on the lower die such that a plurality of minute convex parts or convex parts having an appropriate shape can be formed. Further, the convex parts are not necessarily directed to the inside of the bottom art but can be directed to the outside. Furthermore, the shape of the material supply parts may be, for example, a bulge like a material supply part C-1 shown in FIG. 4(*c*-1) or may be one like a material supply part C-2 shown in FIG. 4(*c*-2) by which a plate thickness distribution is changed when the cylindrical can is formed by impact extrusion. Furthermore, when the material supply parts C and the withdrawing parts L formed in the bottom-part surface during the forming remain on the bottom wall surface of the polygonal can to cause a disadvantage, the bottom wall surface can be appropriate subjected to correction processing after the forming to be corrected into a flat surface or the like to solve the disadvantage.

Furthermore, as the material of the can, a known material such as steel and aluminum and their composite materials can be applied. Furthermore, the decorated surface is not limited to a printed or painted one, but a known decoration method by which a film label is laminated on the can body can be applied. As a matter of course, the present invention is not limited to decorated cans but can also be applied to forming for general can bodies. Furthermore, the present invention can also be applied to polygonal cans having a can body whose cross-sectional surface has a pentagonal shape, a hexagonal shape, or the like.

Figure 2:
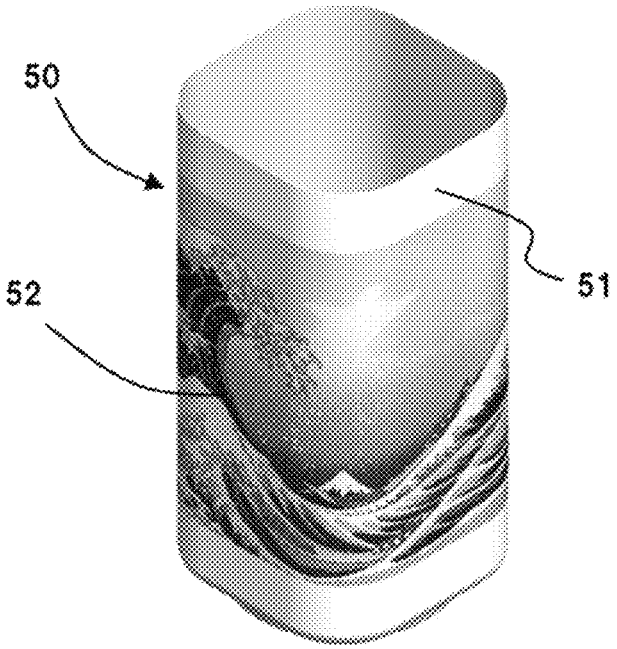
FIG. 2 is a perspective view of a polygonal can according to an embodiment of the present invention.

In a polygonal can 50 of the example formed from a cylindrical base-can in the way described above, a can body-part 51 is free from wrinkles or deformation, and an image 52 printed on the cylindrical base-can by multi-color curved-surface printing is free from deformation as shown in FIG. 2. As a result, the high-quality decorated can was obtained.

Figure 11:
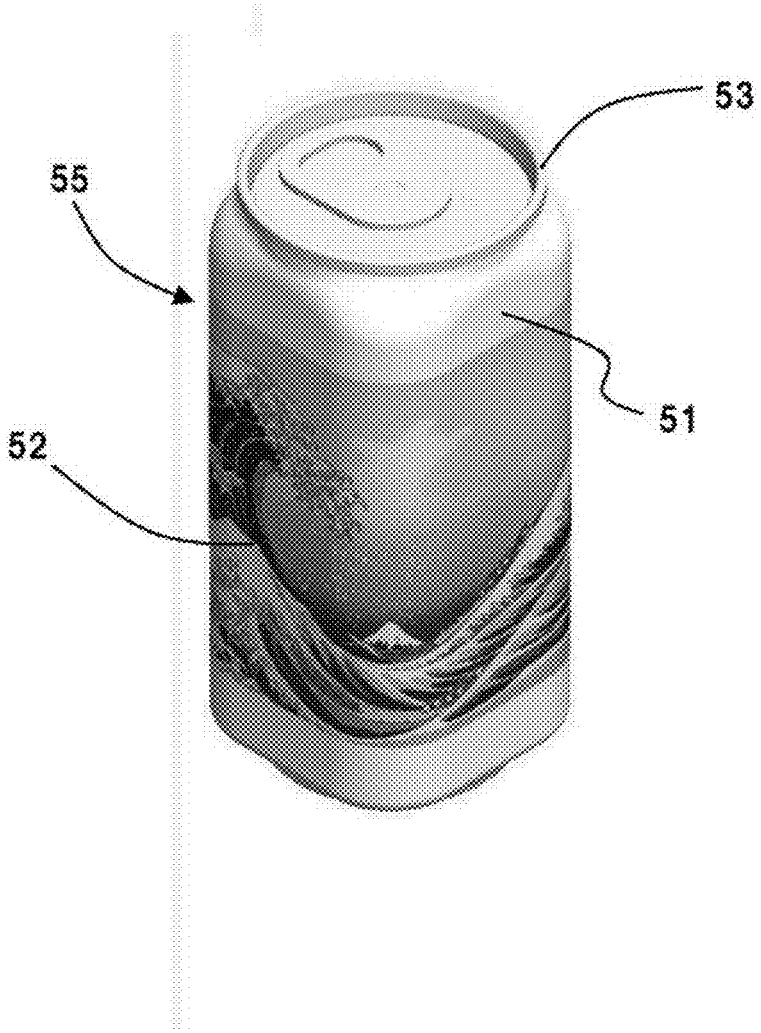
FIG. 11 is a perspective view showing an embodiment of other polygonal-can according to the embodiment of the present invention.

The can formed into a square shape as described above is then subjected to neck-in forming and flange forming where necessary. Note that in the neck-in forming, a can opening-part is formed into a square shape whereby a square can seaming a square can-cover can be obtained, and a can opening-part is formed into a circular shape whereby a polygonal can 55 shown in FIG. 11 having a circular top-end seaming a circular cover can be obtained. FIG. 11 shows a state in which the opening part of the obtained polygonal can is formed into a cylindrical neck and then flanged to form a can main-body and a can cover 53 with a stay-on tab is seamed.

Figure 12:
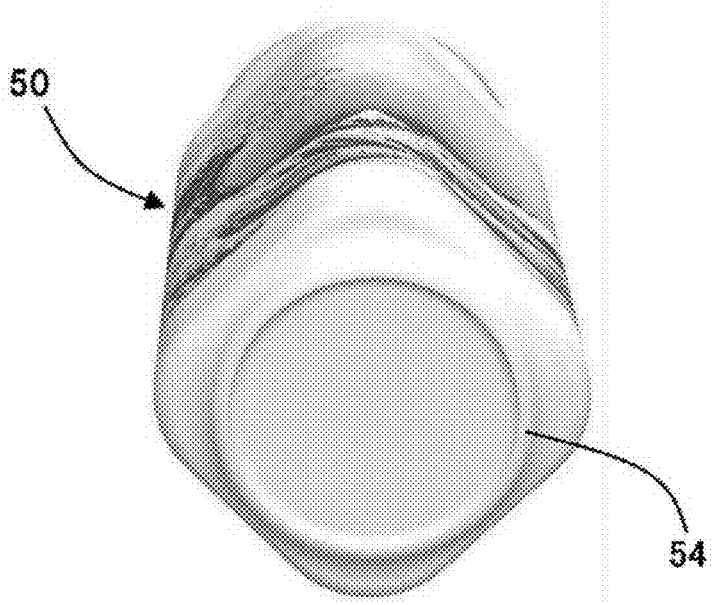
FIG. 12 shows an example of the shape of a bottom-rim-shaped protrusion provided on the bottom part of the polygonal can according to the embodiment of the present invention.

Furthermore, for polygonal cans formed by the forming method, a bottom part may be further subjected to additional processing to have, for example, a bottom-rim-shaped protrusion shown in FIG. 12 for an improvement in conveyance or the like, in the example, a bottom-rim-shaped protrusion 54 is formed as an annular protrusion.

Figure 13:
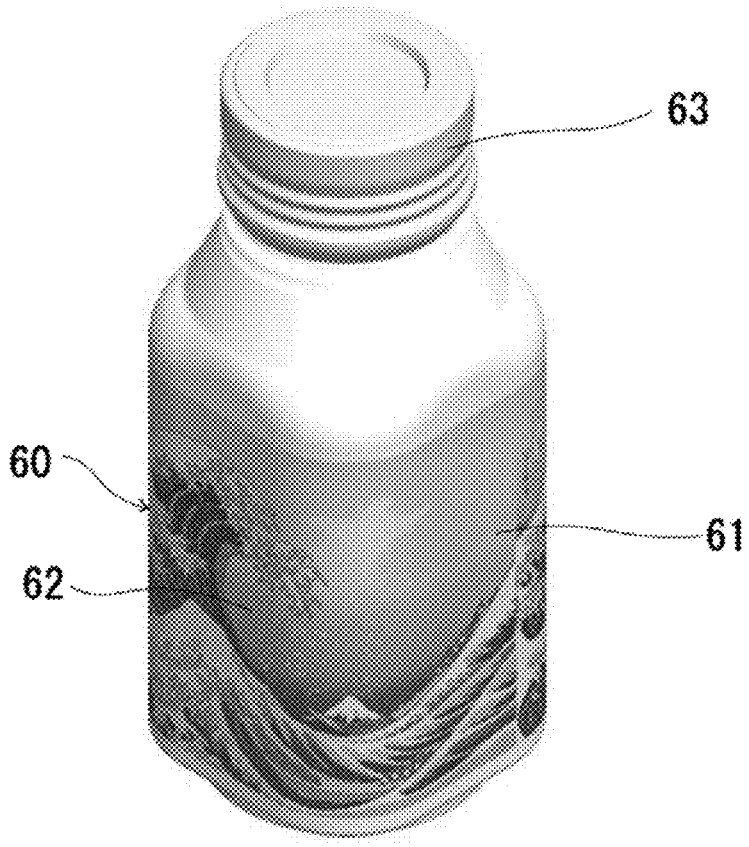
FIG. 13 is a perspective view showing the embodiment of another polygonal-can according to the embodiment of the present invention.
Figure 14:
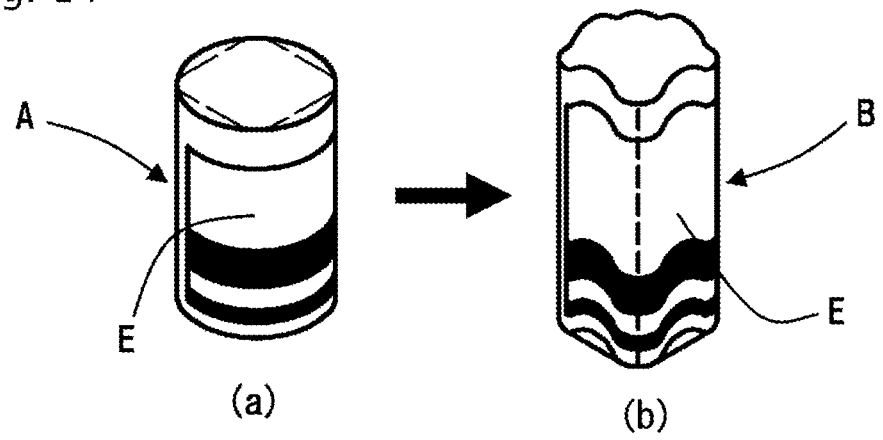
FIG. 14 is a schematic view of a polygonal can having a decorated surface obtained from a bottomed cylindrical-can by a conventional forming method.
Figure 15:
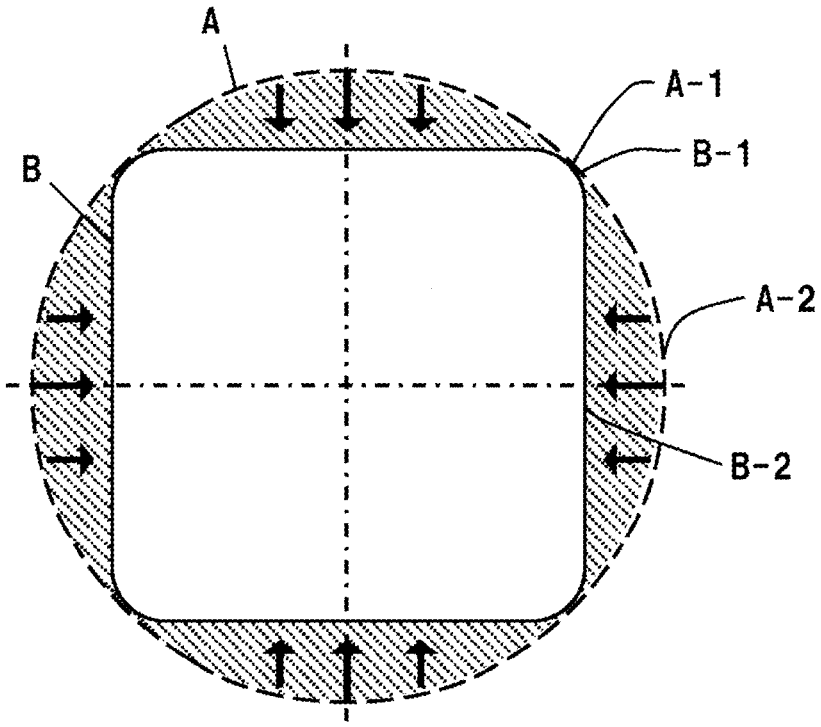
Prior Art Fig. 15
FIG. 15 is a schematic view showing a conventional method for forming a polygonal can from a cylindrical base-can.

Furthermore, as shown in FIG. 13, it is possible to obtain so-called a bottle-can-shaped polygonal can 60 having a square body-part where a screw cap 63 can be attached in such a way that an opening part is formed to have a mouth neck part having a screw part.

INDUSTRIAL APPLICABILITY

The present invention provides a bottomed polygonal can obtained from a bottomed cylindrical base-can and is capable of forming a cylindrical base-can whose body part has been decorated by printing, painting, or the like into a square shape particularly when the cylindrical base-can remains intact without causing deformation in a can body-part. Therefore, the present invention can provide a square decorated can with high quality and high display effect and thus is extremely excellent in industrial applicability.

The invention claimed is:

1. A method for forming a polygonal can by which a cylindrical base-can formed of a body part and a bottom part is formed into the polygonal can having linear parts and corner parts in a cross-section of the body-part, wherein a shape of an outer periphery of the bottom-part is changed into a shape corresponding to a cross-section of the body part of the polygonal can, the method comprising:

moving portions of the outer periphery of the bottom part of the cylindrical base-can inwardly in a radial direction to form the linear parts of the polygonal can;

forming convex parts in some areas of the portions of the cylindrical base-can that are moved inwardly; and moving, other portions of the outer periphery of the bottom part of the cylindrical base-can outwardly in the radial direction to form the corner parts of the polygonal can, wherein a peripheral length of the cross-section of the body part is substantially the same before and after the forming.

2. The method for forming a polygonal can according to claim 1, wherein at least a cylindrical surface of the cylindrical base-can is decorated.

3. The method for forming a polygonal can according to claim 1, wherein material supply parts are formed in some areas of the bottom surface of the cylindrical base-can to form the corner parts at the bottom part of the polygonal can, and the other portions of the outer periphery of the bottom part of the cylindrical base-can are moved outwardly in the radial direction while the material supply parts are pressed by a crushing member inserted in the can.

4. The method for forming a polygonal can according to claim 1, wherein linear-part forming by moving the portions of the outer periphery of the bottom part of the cylindrical base-can inwardly in the radial direction and corner-part forming by moving the other portions of the outer periphery of the bottom part of the cylindrical base-can outwardly in the radial direction are performed in a same step.

5. The method for forming a polygonal can according to claim 1, wherein the moving the portions of the outer periphery of the bottom part of the cylindrical base-can inwardly in the radial direction is accomplished by a press tool.

6. The method for forming a polygonal can according to claim 5, wherein the body part of the polygonal can is embossed by the press tool and a shaft inserted in the can.

* * * * *